US008106841B2

(12) United States Patent
Chen et al.

(10) Patent No.: US 8,106,841 B2
(45) Date of Patent: Jan. 31, 2012

(54) ANTENNA STRUCTURE

(75) Inventors: Yin-Yu Chen, Taipei Hsien (TW); Chen-Yu Chou, Taipei Hsien (TW); Chih-Wei Lee, Taipei Hsien (TW)

(73) Assignee: Wistron Corporation, Xizhi Dist, New Taipei (TW)

( * ) Notice: Subject to any disclaimer, the term of this patent is extended or adjusted under 35 U.S.C. 154(b) by 476 days.

(21) Appl. No.: 12/407,764

(22) Filed: Mar. 19, 2009

(65) Prior Publication Data

US 2010/0201588 A1 Aug. 12, 2010

(30) Foreign Application Priority Data

Feb. 9, 2009 (TW) ..... 98201842 U

(51) Int. Cl.
*H01Q 21/24* (2006.01)

(52) U.S. Cl. ..... 343/756; 343/700 MS; 343/702; 343/846; 343/860

(58) Field of Classification Search ..... 343/700 MS, 343/702, 756, 795, 806, 809, 828, 829, 846, 343/860
See application file for complete search history.

(56) References Cited

U.S. PATENT DOCUMENTS 6,133,879 A * 10/2000 Grangeat et al. ..... 343/700 MS
6,160,513 A * 12/2000 Davidson et al. ..... 343/700 MS
6,356,242 B1 * 3/2002 Ploussios ..... 343/795
6,496,148 B2 * 12/2002 Ngounou Kouam et al. . 343/700 MS
7,109,923 B2 * 9/2006 Ollikainen et al. .... 343/700 MS
7,289,068 B2 * 10/2007 Fujio et al. ..... 343/700 MS
7,830,327 B2 * 11/2010 He ..... 343/828
2010/0277376 A1 * 11/2010 Chakam et al. ..... 343/702

* cited by examiner

*Primary Examiner* — Douglas W Owens
*Assistant Examiner* — Chuc Tran
(74) *Attorney, Agent, or Firm* — Winston Hsu; Scott Margo

(57) ABSTRACT

An antenna structure consists of a substrate, a radiation element, a signal feeding element, and a grounding element. The radiation element includes a first radiator and a second radiator coupled to the first radiator, wherein the first radiator is identical to the second radiator. The signal feeding element is coupled to a joint of the first radiator and the second radiator, wherein the first radiator and the second radiator are symmetrically disposed in the left and right sides of the signal feeding element to permute an array. The grounding element includes a first grounding sub-element and a second grounding sub-element, wherein the first grounding sub-element is coupled between the first radiator and the substrate and the second grounding sub-element is coupled between the second radiator and the substrate. The first grounding sub-element is identical to the second grounding sub-element.

18 Claims, 6 Drawing Sheets

XZ-Plane

YZ-Plane

XY-Plane

ANTENNA STRUCTURE

BACKGROUND OF THE INVENTION

1. Field of the Invention

The present invention relates to an antenna, and more particularly, to a new antenna structure constructed by combining two (or more) identical antennas being symmetrically disposed in the left and right sides of a signal feeding element (e.g., arranged in an array), so as to achieve a goal of simultaneously receiving a LHCP signal and a RHCP signal.

2. Description of the Prior Art

Recently, requirements for satellite receiving systems have increased year by year due to satellite communication services having characteristics of wide bandwidth, data broadcasting, and being borderless. However, the resources for satellite bandwidth are finite. Thus, transmission manners such as linear polarization transmission and circular polarization transmission are developed to make better use of the satellite bandwidth. The linear polarization transmission consists of vertical linear polarization (VLP) and horizontal linear polarization (HLP), wherein the magnitude of its electric field varies over time but the direction of the electric field remains the same. The circular polarization transmission consists of right-hand circular polarization (RHCP) and left-hand circular polarization (LHCP), wherein the magnitude of its electric field does not vary over time, but the direction of the electric field does.

At present, patch antennas or ceramic chip antennas made up of ceramic materials are usually used for receiving the circular polarization signals in the satellite receiving systems. Since the ceramic materials have larger dielectric constants and smaller dielectric losses, they are suitable for high-frequency communications. However, regardless of patch antennas or ceramic chip antennas, the products must have the corresponding thickness due to the thicknesses of such antennas are thicker (about 5~10 mm). In addition, a single antenna of the present satellite receiving systems can only be used for receiving the RHCP signal or the LHCP signal. Hence, two antennas are required to be able to simultaneously receive the RHCP signal or the LHCP signal. That is, the radiation efficiency and the directionality of magnetic field of such antennas are obviously insufficient.

SUMMARY OF THE INVENTION

It is one of the objectives of the present invention to provide an antenna structure to solve the abovementioned problems.

According to an exemplary embodiment of the present invention, an antenna structure is provided. The antenna structure includes a substrate, a radiation element, a signal feeding element, and a grounding element. The radiation element includes a first radiator and a second radiator coupled to the first radiator, wherein the first radiator is identical to the second radiator. The signal feeding element is coupled to a joint of the first radiator and the second radiator, wherein the first radiator and the second radiator are symmetrically disposed in the left and right sides of the signal feeding element. The grounding element includes a first grounding sub-element and a second grounding sub-element, wherein the first grounding sub-element is coupled between the first radiator and the substrate and the second grounding sub-element is coupled between the second radiator and the substrate. The first grounding sub-element is identical to the second grounding sub-element. The antenna structure is constructed by a PCB.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
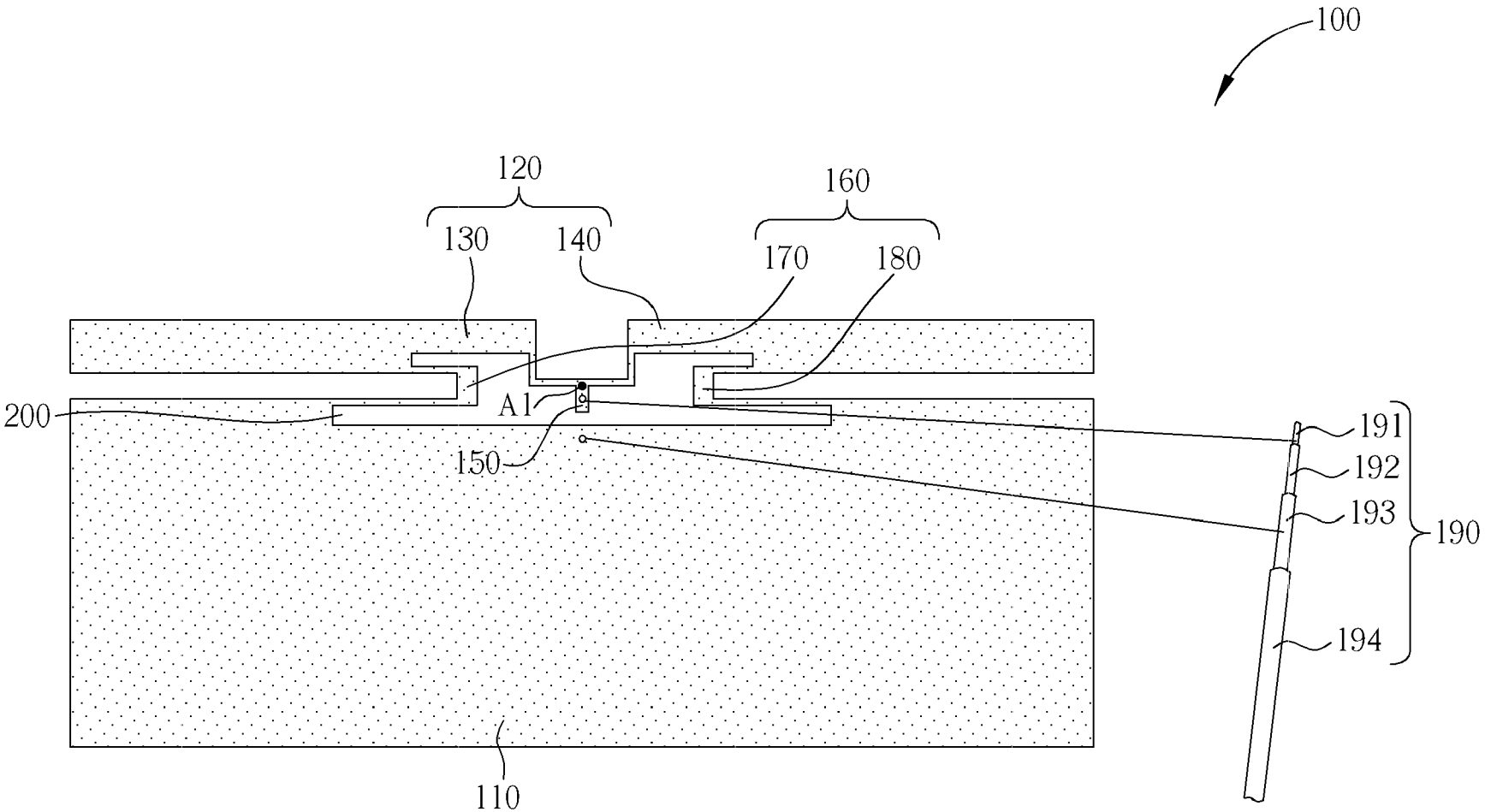
FIG. 1 is a diagram of an antenna structure according to a first embodiment of the present invention.

Please refer to FIG. 1. FIG. 1 is a diagram of an antenna structure 100 according to a first embodiment of the present invention. As shown in FIG. 1, the antenna structure 100 consists of a substrate 110, a radiation element 120, a signal feeding element 150, and a grounding element 160. The radiation element 120 includes a first radiator 130 and a second radiator 140 coupled to the first radiator 130, wherein the first radiator 130 is identical to the second radiator 140. The signal feeding element 150 is coupled to a joint A1 of the first radiator 130 and the second radiator 140, wherein the first radiator 130 and the second radiator 140 are symmetrically disposed in the left and right sides of the signal feeding element 150. In other words, the first radiator 130 and the second radiator 140 are arranged in an array. The grounding element 160 includes a first grounding sub-element 170 and a second grounding sub-element 180, wherein the first grounding sub-element 170 is coupled between the first radiator 130 and the substrate 110 and the second grounding sub-element 180 is coupled between the second radiator 140 and the substrate 110. The first grounding sub-element 170 is identical to the second grounding sub-element 180. In this embodiment, the substrate 110, the grounding element 160 (including the first grounding sub-element 170 and the second grounding sub-element 180), the radiation element 120 (including the first radiator 130 and the second radiator 140), and the signal feeding element 150 form a sealed region 200.

Besides, the signal feeding element 150 is further connected to a coaxial cable 190 having a first conductor layer 191, a first isolation layer 192, a second conductor layer 193, and a second isolation layer 194, wherein the first isolation layer 192 covers the first conductor layer 191 and lies in between the first conductor layer 191 and the second conductor layer 193, the second isolation layer 194 covers the second conductor layer 193. The first conductor layer 191 is coupled to the signal feeding element 150, and the second conductor layer 193 is coupled to the substrate 110. The substrate 110 consists of dielectric material and is connected to a system ground terminal electrically. The antenna structure 100 is installed inside a wireless communication device, such as a global positioning system (GPS) or a portable navigation device (PND).

As can be known from FIG. 1, the first radiator 130, the first grounding sub-element 170, the substrate 110 and the signal feeding element 150 can be viewed as a first planner inverted-F antenna (PIFA), while the second radiator 140, the second grounding sub-element 180, the substrate 110 and the signal feeding element 150 can be viewed as a second PIFA. The first radiator 130 is used for receiving a LHCP signal and the second radiator 140 is used for receiving a RHCP signal. In other words, two identical PIFAs are combined and are symmetrically disposed in the left and right sides of the signal feeding element 150 (e.g., arranged in an array) to construct a new antenna structure in the present invention, so as to achieve the goal of simultaneously receiving a LHCP signal and a RHCP signal.

Be noted that the antenna structure 100 is a monopole antenna for receiving the signals falling within a single frequency range, e.g. 1.5754 GHz, but the frequency range of the antenna should not be considered as limitations of the present invention.

In this embodiment, each of the first radiator 130 and the second radiator 140 respectively has at least one bend, but this should not be considered to be limitations of the present invention. The shape and the number of bends of the first radiator 130 and the second radiator 140 are not restricted. In addition, the first grounding sub-element 170 and the second grounding sub-element 180 can respectively consist of at least one bend, but the present invention is not limited to this only. Those skilled in the art should appreciate that various modifications of the first radiator 130, the second radiator 140, the first grounding sub-element 170, and the second grounding sub-element 180 may be made without departing from the spirit of the present invention. However, the first radiator 130 and the second radiator 140 must be identical, and the first grounding sub-element 170 and the second grounding sub-element 180 must be identical, so as to achieve the optimum performance upon receiving the LHCP signal and the RHCP signal simultaneously.

Please note that the antenna structure 100 can be designed by adopting a PCB to replace the ceramic chip antennas made up of ceramic materials. Since the thickness of the PCB (such as FR4) is merely 0.4~1.6 mm, thereby not only can the thickness of the products be substantially reduced but also can the follow-up assembly procedure be simplified. Moreover, by adopting the PCB as the substrate, the manufacture cost of the antenna can be reduced.

Figure 2:
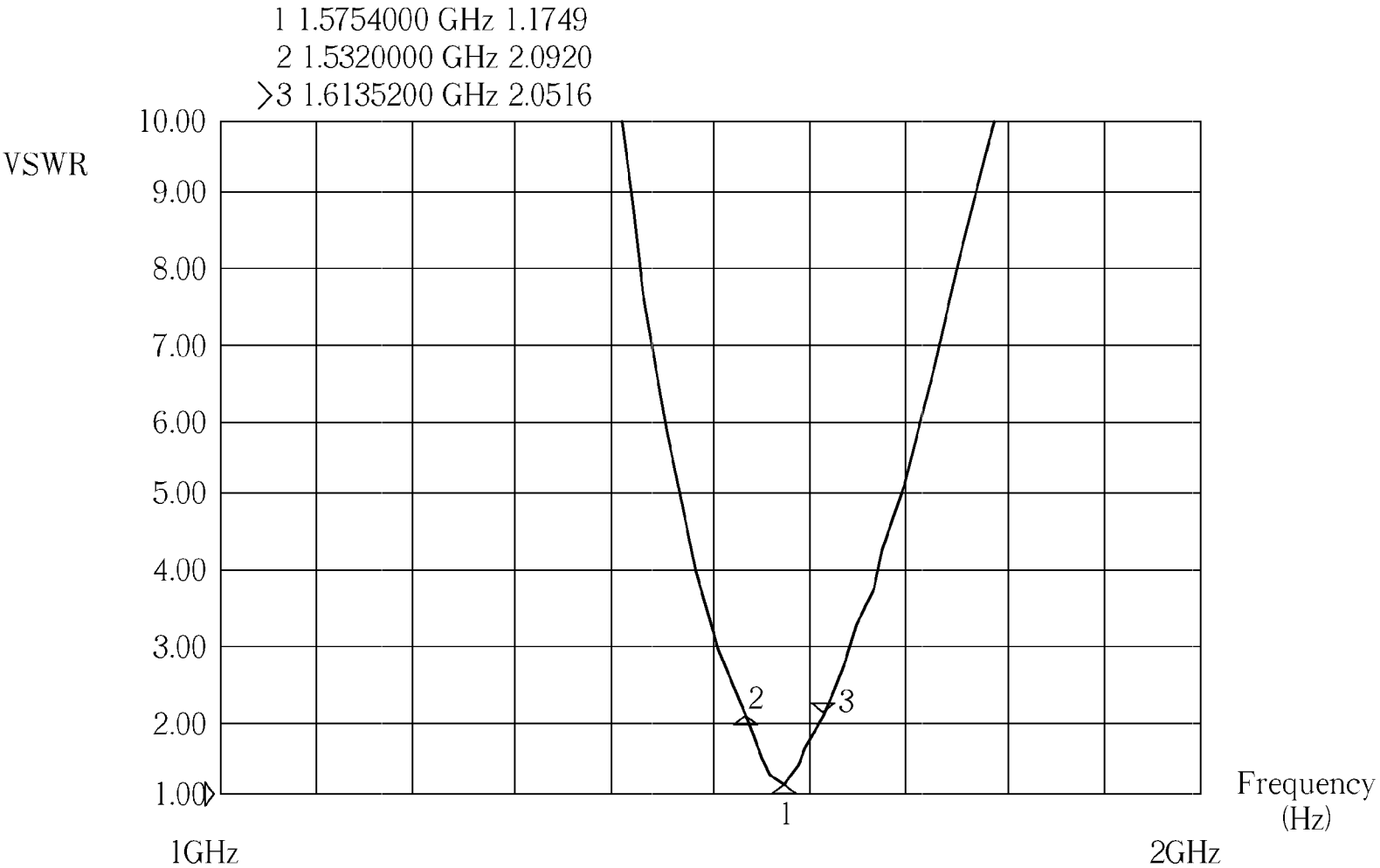
FIG. 2 is a diagram illustrating the VSWR of the antenna structure in FIG. 1.

Please refer to FIG. 2. FIG. 2 is a diagram illustrating the VSWR of the antenna structure 100 shown in FIG. 1. The horizontal axis represents frequency (GHz) that distributes from 1 GHz to 2 GHz, and the vertical axis represents VSWR. As shown in FIG. 2, the antenna structure 100 has excellent VSWR in the vicinity of the frequency 1.5754 GHz (i.e., the VSWR is smaller than 2), which can satisfy operational demands of GPS.

Figure 3:
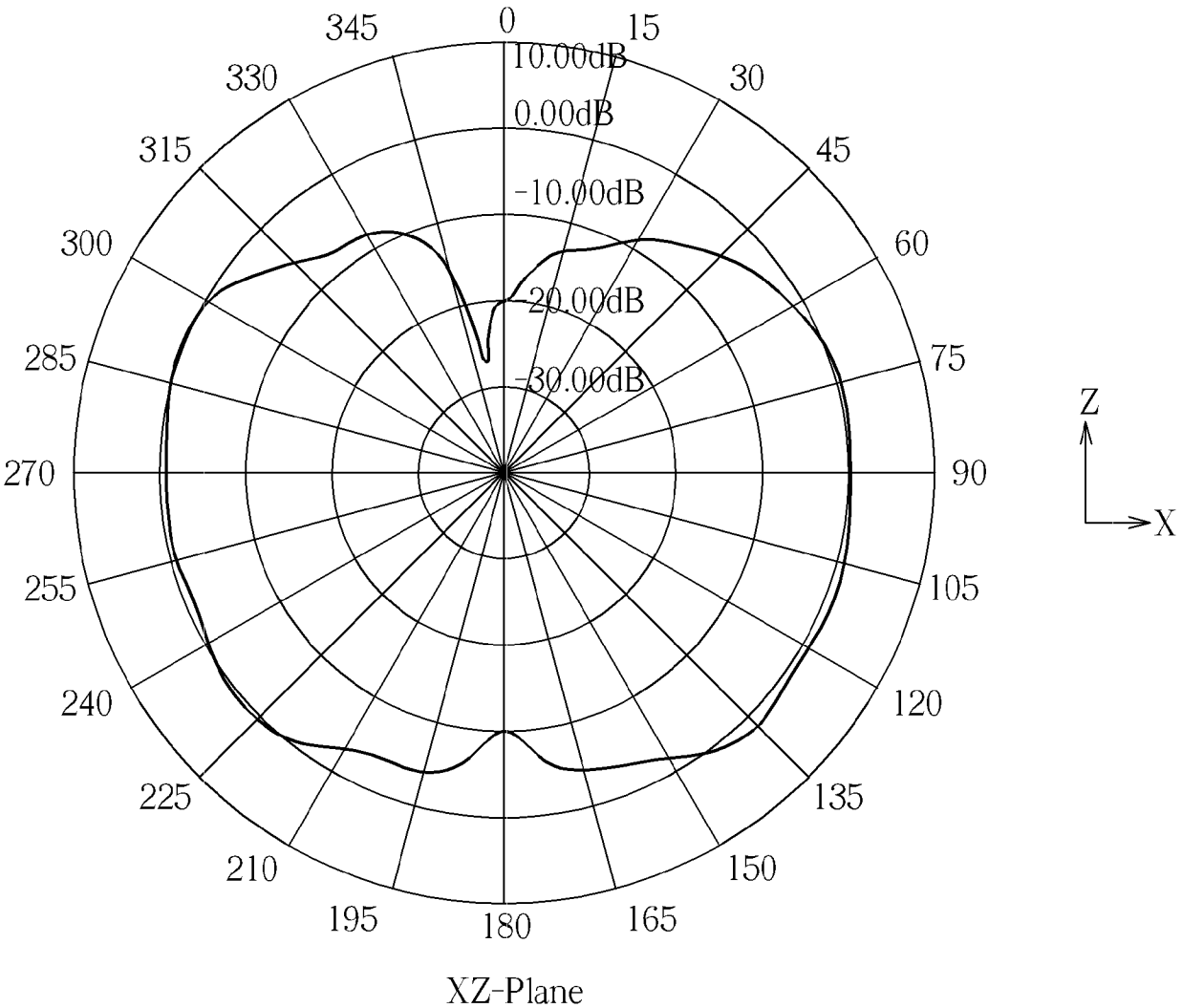
FIG. 3 is a diagram showing a radiation pattern of the antenna structure in FIG. 1.
Figure 4:
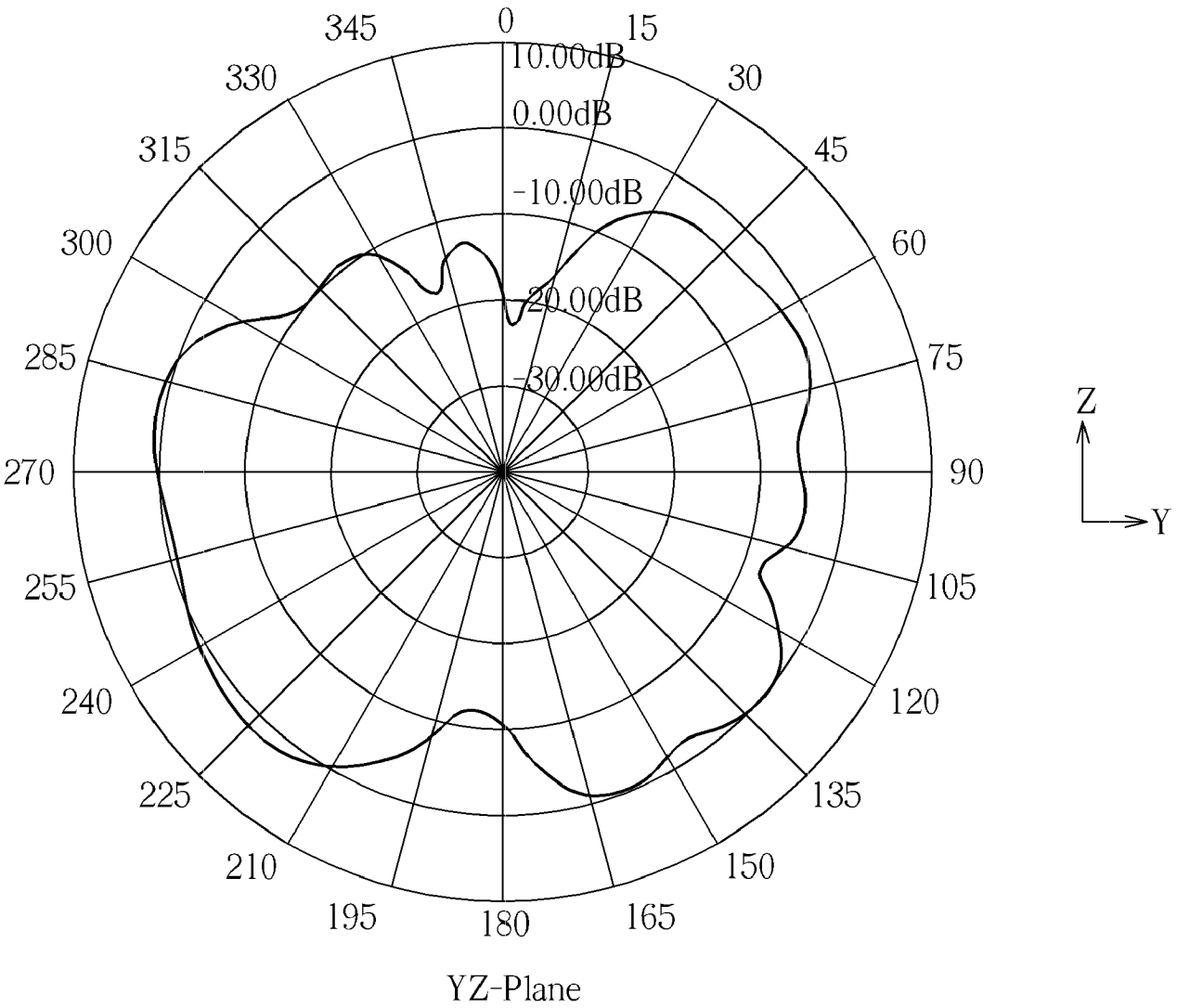
FIG. 4 is a diagram showing another radiation pattern of the antenna structure in FIG. 1.
Figure 5:
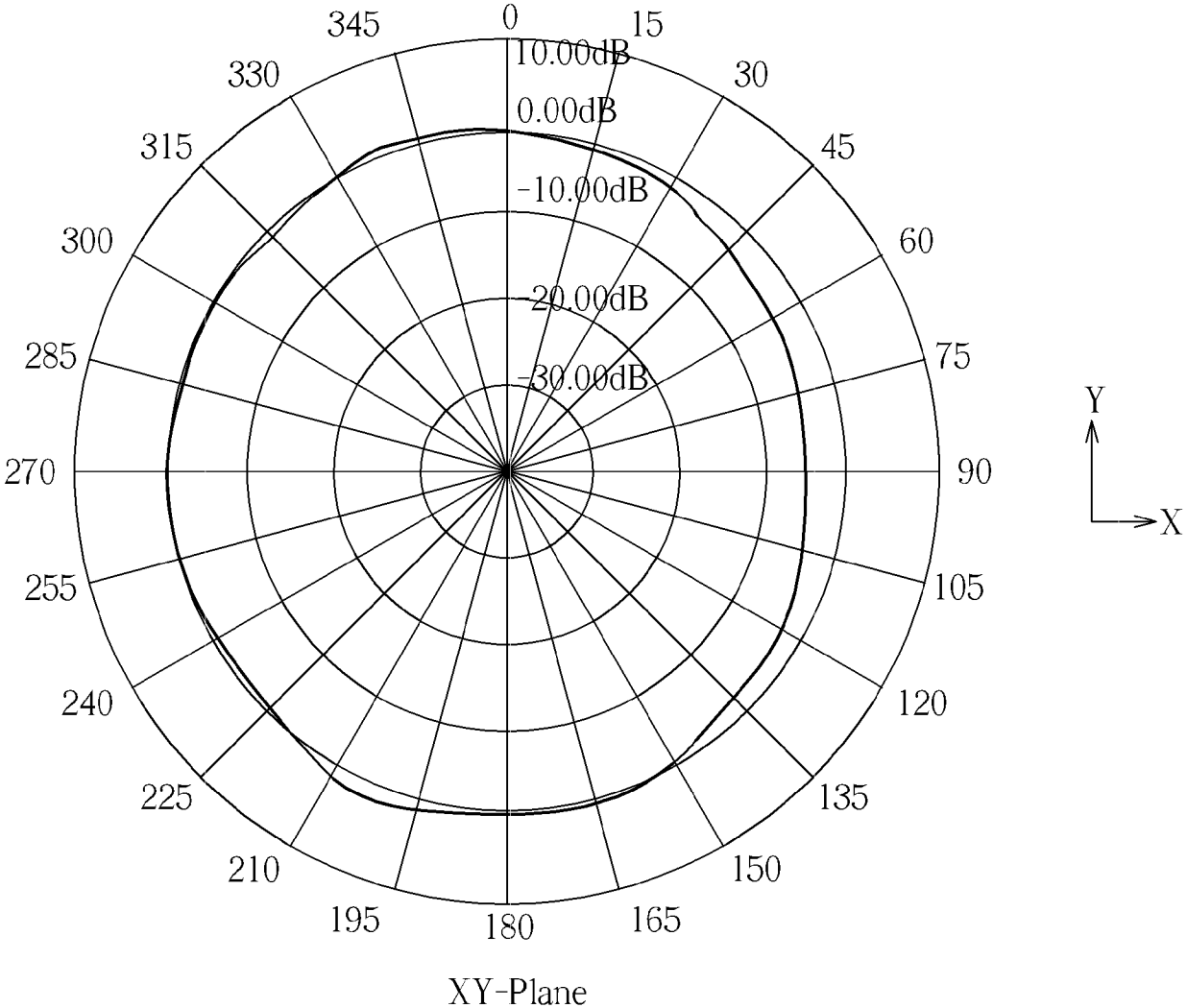
FIG. 5 is a diagram showing another radiation pattern of the antenna structure in FIG. 1.

Please refer to FIG. 3, FIG. 4, and FIG. 5. Each of the figures FIG. 3, FIG. 4, and FIG. 5 is a diagram showing a radiation pattern of the antenna structure 100 shown in FIG. 1. FIG. 3 represents measuring results of the antenna structure 100 in the ZX plane, FIG. 4 represents measuring results of the antenna structure 100 in the YZ plane, and FIG. 5 represents measuring results of the antenna structure 100 in the XY plane. As can be seen from FIG. 3 and FIG. 4, the radiation patterns of the antenna structure 100 in the ZX plane and the YZ plane are symmetrical and are able to receive the LHCP signal and the RHCP signal simultaneously. As can be seen from FIG. 5, the radiation pattern of the antenna structure 100 in the XY plane approximates a circle, which consists of a great coverage and higher radiation efficiency.

The antenna structure 100 shown in FIG. 1 is merely an exemplary embodiment of the present invention, and in no way should be considered to be limitations of the scope of the present invention. Those skilled in the art should appreciate that various modifications of the antenna structure 100 may be made without departing from the spirit of the present invention.

Figure 6:
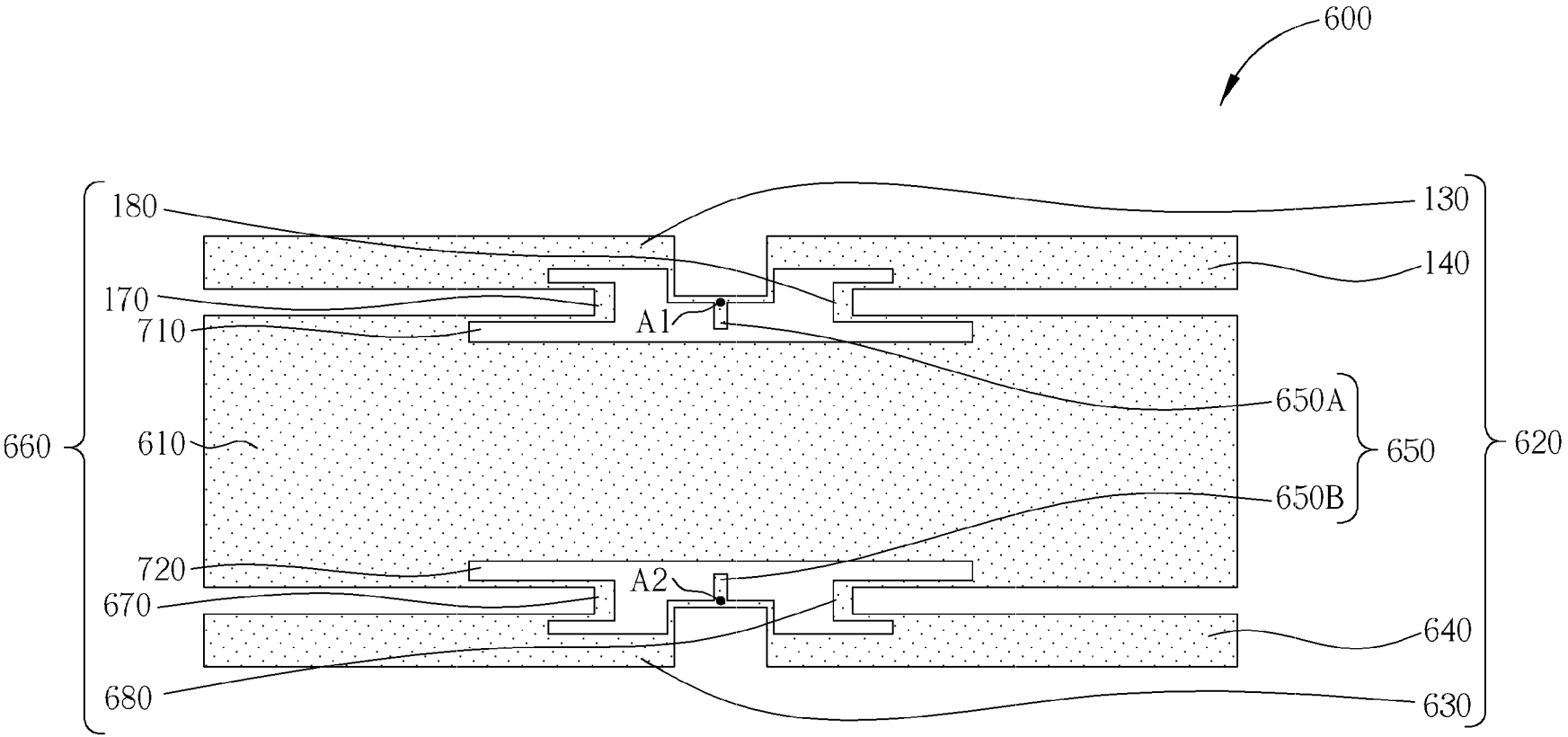
FIG. 6 is a diagram of an antenna structure according to a second embodiment of the present invention.

Please refer to FIG. 6. FIG. 6 is a diagram of an antenna structure 600 according to a second embodiment of the present invention, which is a changed form of the antenna structure 100 shown in FIG. 1. The architecture of the antenna structure 600 in FIG. 6 is similar to the antenna structure 100 in FIG. 1, and the difference between them is that a radiation element 620 of the antenna structure 600 further consists of a third radiator 630 and a fourth radiator 640 and a grounding element 660 of the antenna structure 600 further consists of a third grounding sub-element 670 and a fourth grounding sub-element 680. The fourth radiator 640 is coupled to the third radiator 630, wherein the first radiator 130, the second radiator 140, the third radiator 630, and the fourth radiator 640 are identical. A signal feeding element 650 of the antenna structure 600 consists of a first part 650A and a second part 650B, wherein the second part 650B of the signal feeding element 650 is coupled to a joint A2 of the third radiator 630 and the fourth radiator 640. The third radiator 630 and the fourth radiator 640 are symmetrically disposed in the left and right sides of the second part 650B of the signal feeding element 650. In addition, the third grounding sub-element 670 is coupled between the third radiator 630 and the substrate 610 and the fourth grounding sub-element 680 is coupled between the fourth radiator 640 and the substrate 610. The first grounding sub-element 170, the second grounding sub-element 180, the third grounding sub-element 670, and the fourth grounding sub-element 680 are identical.

In this embodiment, the substrate 610, the first grounding sub-element 170, the second grounding sub-element 180, the first radiator 130, the second radiator 140, and the first part 650A of the signal feeding element 650 form a sealed region 710. The substrate 610, the third grounding sub-element 670, the fourth grounding sub-element 680, the third radiator 630, the fourth radiator 640, and the second part 650B of the signal feeding element 650 form another sealed region 720.

As can be known from FIG. 6, the first radiator 130, the second radiator 140, the third radiator 630, and the fourth radiator 640 of the radiation element 620 are symmetrically disposed in the left and right sides of the signal feeding element 650 (including the first part 650A and the second part 650B) to permute an array. In other words, four identical PIFAs are combined and are arranged in an array to construct a new antenna structure in this embodiment, so as to achieve the goal of simultaneously receiving a LHCP signal and a RHCP signal. Furthermore, the second part 650B and the first part 650A of the signal feeding element 650 are connected to each other (not shown).

Please note that the antenna structures 100 and 600 are merely an exemplary embodiment of the present invention, and, as is well known by a person of ordinary skill in the art, this should not be seen as limitations of the present invention. In other embodiments, eight, sixteen, or more identical PIFAs can be combined and arranged in an array to construct a new antenna structure, so as to achieve the goal of simultaneously receiving a LHCP signal and a RHCP signal. Furthermore, the arranged manner of the antenna structure is not limited. For example, the four identical PIFAs shown in FIG. 6 are arranged in a square. In other embodiments, the four identical PIFAs can be arranged in a slender type, which should also belong to the scope of the present invention.

The abovementioned embodiments are presented merely for illustrating practicable designs of the present invention, and in no way should be considered to be limitations of the scope of the present invention. Certainly, those skilled in the art should appreciate that various modifications of the antenna structures shown in FIG. 1 and FIG. 6 may be made without departing from the spirit of the present invention.

In summary, the present invention provides an antenna structure, which is constructed by combining two (or more) identical antennas, e.g. PIFAs, being symmetrically disposed in the left and right sides of the signal feeding element (for example, the PIFAs are arranged in an array). Therefore, the optimum performance upon receiving the LHCP signal and the RHCP signal simultaneously via a single antenna structure can be achieved. In addition, the antenna structure disclosed in the present invention adopts a PCB to replace the ceramic materials. Therefore, not only can the thickness of the products be substantially reduced but also can the manufacture cost of the antenna can be lowered. Moreover, the antenna structure disclosed in the present invention has excellent VSWR, better radiation efficiency, and wider directionality of magnetic field, which can satisfy operational demands of GPS.

Those skilled in the art will readily observe that numerous modifications and alterations of the device and method may be made while retaining the teachings of the invention.

What is claimed is:

1. An antenna structure, comprising:

a substrate;

a radiation element, comprising a first radiator and a second radiator coupled to the first radiator, wherein the first radiator is identical to the second radiator, and the first radiator is used as a left-hand circular polarization antenna and the second radiator is used as a right-hand circular polarization antenna;

a signal feeding element, coupled to a joint of the first radiator and the second radiator, wherein the first radiator and the second radiator are symmetrically disposed in the left and right sides of the signal feeding element; and a grounding element, comprising:

a first grounding sub-element, coupled between the first radiator and the substrate; and a second grounding sub-element, coupled between the second radiator and the substrate, wherein the first grounding sub-element is identical to the second grounding sub-element.

2. The antenna structure of claim 1, wherein the antenna structure is constructed by a printed circuit board.

3. The antenna structure of claim 1, wherein the antenna structure is a monopole antenna.

4. The antenna structure of claim 1, wherein the first grounding sub-element comprises at least one bend and the second grounding sub-element comprises at least one bend.

5. The antenna structure of claim 1, wherein the radiation element further comprises:

a third radiator; and a fourth radiator, coupled to the third radiator, the first radiator, the second radiator, the third radiator, and the fourth radiator being identical;

wherein the signal feeding element is coupled to a joint of the third radiator and the fourth radiator, and the third radiator and the fourth radiator are symmetrically disposed in the left and right sides of the signal feeding element so as to permute an array as well as the first radiator and the second radiator.

6. The antenna structure of claim 5, wherein the grounding element further comprises:

a third grounding sub-element, coupled between the third radiator and the substrate; and a fourth grounding sub-element, coupled between the fourth radiator and the substrate, wherein the first grounding sub-element, the second grounding sub-element, the third grounding sub-element, and the fourth grounding sub-element are identical.

7. An antenna structure, comprising:

a signal feeding element;

a radiation element, comprising:

a first radiator, coupled to the signal feeding element; and a second radiator, coupled to the first radiator and the signal feeding element, wherein the first radiator and the second radiator are identical and are symmetrically disposed in the left and right sides of the signal feeding element;

a substrate; and a grounding element, comprising:

a first grounding sub-element, coupled between the first radiator and the substrate; and a second grounding sub-element, coupled between the second radiator and the substrate, wherein the first grounding sub-element is identical to the second grounding sub-element;

wherein the signal feeding element, the radiation element, the substrate, and the grounding element form a sealed region.

8. The antenna structure of claim 7, wherein the antenna structure is constructed by a printed circuit board.

9. The antenna structure of claim 7, wherein the first radiator is used as a left-hand circular polarization antenna and the second radiator is used as a right-hand circular polarization antenna.

10. The antenna structure of claim 7, wherein the first grounding sub-element comprises at least one bend and the second grounding sub-element comprises at least one bend.

11. The antenna structure of claim 7, wherein the radiation element further comprises:

a third radiator; and a fourth radiator, coupled to the third radiator, the first radiator, the second radiator, the third radiator, and the fourth radiator being identical;

wherein the signal feeding element is coupled to a joint of the third radiator and symmetrically disposed in the left and right sides of the signal feeding element so as to permute an array as well as the first radiator and the second radiator.

12. The antenna structure of claim 11, wherein the grounding element further comprises:

a third grounding sub-element, coupled between the third radiator and the substrate; and a fourth grounding sub-element, coupled between the fourth radiator and the substrate, wherein the first grounding sub-element, the second grounding sub-element, the third grounding sub-element, and the fourth grounding sub-element are identical.

13. The antenna structure of claim 7, wherein the sealed region is symmetric.

14. An antenna structure, comprising:

a substrate;

a radiation element, comprising a first radiator, a second radiator coupled to the first radiator, a third radiator and a fourth radiator coupled to the third radiator, wherein the first radiator, the second radiator, the third radiator and the fourth radiator are identical;

a signal feeding element, coupled to a joint of the first radiator and the second radiator and a joint of the third radiator and the fourth radiator, wherein the first radiator and the second radiator are symmetrically disposed in the left and right sides of the signal feeding element, and the third radiator and the fourth radiator are symmetrically disposed in the left and right sides of the signal feeding element so as to permute an array as well as the first radiator and the second radiator; and a grounding element, comprising:

a first grounding sub-element, coupled between the first radiator and the substrate; and a second grounding sub-element, coupled between the second radiator and the substrate, wherein the first grounding sub-element is identical to the second grounding sub-element.

15. The antenna structure of claim 14, wherein the antenna structure is constructed by a printed circuit board.

16. The antenna structure of claim 14, wherein the antenna structure is a monopole antenna.

17. The antenna structure of claim 14, wherein the first grounding sub-element comprises at least one bend and the second grounding sub-element comprises at least one bend.

18. The antenna structure of claim 14, wherein the grounding element further comprises:

a third grounding sub-element, coupled between the third radiator and the substrate; and a fourth grounding sub-element, coupled between the fourth radiator and the substrate, wherein the first grounding sub-element, the second grounding sub-element, the third grounding sub-element, and the fourth grounding sub-element are identical.

* * * * *